United States Patent [19]

George

[11] Patent Number: 4,748,750

[45] Date of Patent: Jun. 7, 1988

[54] CLEATED ATHLETIC SHOE

[76] Inventor: Gary F. George, 406 Barclay, Grosse Pointe Farms, Mich. 48236

[21] Appl. No.: 9,222

[22] Filed: Jan. 30, 1987

[51] Int. Cl.[4] ..... A43C 15/00; A43C 15/04

[52] U.S. Cl. ..... 36/59 R; 36/67 R; 36/114; 36/134; D2/320; D2/317

[58] Field of Search ..... 36/114, 126, 128, 134, 36/59 R, 59 C, 59 A, 59 B, 67 R, 67 A; D2/311, 317, 320

[56] References Cited

U.S. PATENT DOCUMENTS

| | | | |
|---|---|---|---|
| 3,127,687 | 4/1964 | Hollister et al. | 36/114 |
| 3,466,763 | 9/1969 | Levin | 36/126 |
| 3,577,663 | 5/1971 | Mershon . | |
| 3,581,414 | 6/1971 | Crawford | 36/59 R |
| 3,739,497 | 6/1973 | Cameron . | |
| 4,315,374 | 2/1982 | Sneeringer . | |
| 4,347,674 | 9/1982 | George . | |
| 4,392,312 | 7/1983 | Crowley et al. | 36/67 R |
| 4,586,274 | 5/1986 | Blair | 36/59 R |

*Primary Examiner*—James Kee Chi

*Attorney, Agent, or Firm*—Gifford, Groh, VanOphem, Sheridan, Sprinkle and Dolgorukov

[57] ABSTRACT

An athletic shoe of the type having an elongated sole, a front, a back, an inner side and an outer side and at least one cleat extending outwardly from the sole. The cleat includes a forwardly facing surface and an outwardly facing surface which taper towards each other and meet each other adjacent one side of the sole so that the forwardly facing and outwardly facing surfaces are generally V-shaped when viewed in plan. An inwardly facing surface extends longitudinally between the other ends of the forwardly and outwardly facing sides. In use, the inwardly facing surface of the cleat provides traction as the athlete steps sidewardly. Conversely, the tapering forward and outwardly facing surfaces minimize traction in the event of a transverse blow to the athlete's legs.

9 Claims, 1 Drawing Sheet

CLEATED ATHLETIC SHOE

BACKGROUND OF THE INVENTION

I. Field of the Invention

The present invention relates generally to shoes and, more particularly, to a cleated athletic shoe.

II. Description of the Prior Art

There are many sports, such as football, baseball, soccer and the like, in which cleated athletic shoes are used during play. These previously known shoes typically comprise a sole having a plurality of cleats which protrude outwardly from the sole and which penetrate the ground surface in order to provide traction for the athlete. These cleats are constructed of any hard or rigid material, such as metal, plastic, hard rubber and the like.

While these previously known cleated athletic shoes provide satisfactory traction for the athlete when desired, i.e. when the athlete desires to move in one direction or another, they also inhibit movement of the shoe when traction is undesireable. Traction would be undesireable, for example, in the event of a sideward or transverse blow to the athlete's legs.

More specifically, when the athlete suffers a transverse blow to his or her legs while wearing cleated athletic shoes, the cleats and particularly the heel cleats tend to immobilize the shoe, and thus the athlete's feet even though the tranverse blow to the athlete's legs creates a light transverse force on the athlete's feet. This in turn frequently results in knee injuries, ankle injuries and the like.

SUMMARY OF THE PRESENT INVENTION

The present invention provides a cleated athletic shoe which overcomes all the above mentioned disadvantages.

In brief, the athletic shoe of the present invention comprises an elongated sole having a front, a back, an inner side and an outer side. The inside and outside of the sole extend between the front and the back and are spaced apart from each other.

At least one, and preferably several, cleats extend downwardly from the sole and, more particularly, downwardly from the heel of the sole. Each cleat, furthermore, comprises a forwardly facing surface and an outwardly facing surface which taper towards each other and meet each other at a point adjacent one side of the sole. The forwardly and outwardly facing surfaces of the cleat are generally V-shaped when viewed in plan.

In addition, the cleat also comprises an inwardly facing surface extending longitudinally between the other or inner ends of both the forwardly and outwardly facing cleat surfaces. Preferably, this inwardly facing surface includes a U-shaped recess which faces the other side of the sole, i.e. the side of the sole opposite from the side adjacent the junction of the forwardly and outwardly facing cleat surfaces.

In use, the inwardly facing cleat surface provides lateral traction as the athlete steps from one side and to the other. Conversely, when the athlete suffers a transverse blow to his or her legs, the tapering forwardly and outwardly facing cleat surfaces minimize the amount of traction between the cleats and the ground and thus allows the shoe to slide laterally. This, in turn, minimizes injurious forces and stresses in the athlete's legs and feet.

BRIEF DESCRIPTION OF THE DRAWING

A better understanding of the present invention will be had upon references to the following detailed description when read in conjunction with the accompanying drawing, wherein like references refer to like parts throughout the several views, and in which.

DETAILED DESCRIPTION OF A PREFERRED EMBODIMENT OF THE PRESENT INVENTION

Figure 1:
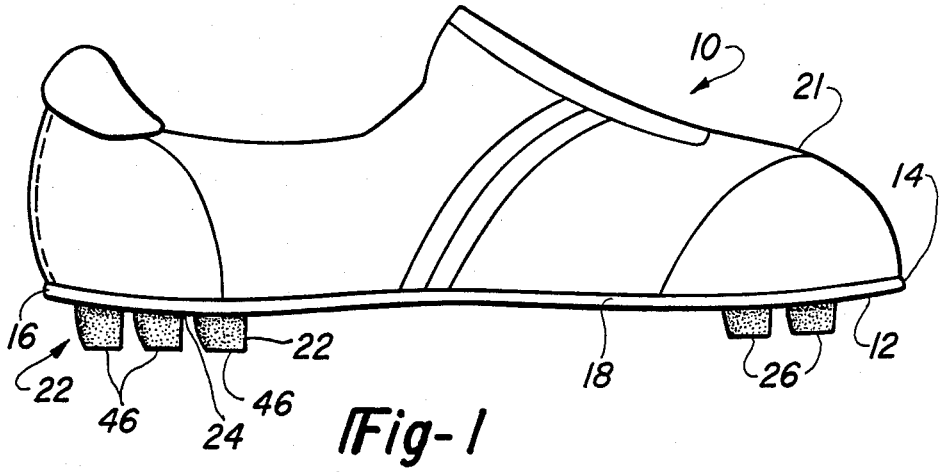
FIG. 1 is a side view illustrating a preferred embodiment of the present invention.

With reference first to FIG. 1, a preferred embodiment of the athletic shoe 10 of the present invention is thereshown in which the athletic shoe comprises a sole 12 having a front 14, a back 16 and two sides 18 and 20. As shown, one of these sides 18 and 20 is the inside of the shoe while, conversely, the other side 18 or 20 is the outside of the shoe depending on whether the shoe is a right shoe or a left shoe. A conventional upper 21 is secured to the sole 12 in any conventional fashion.

Figure 2:
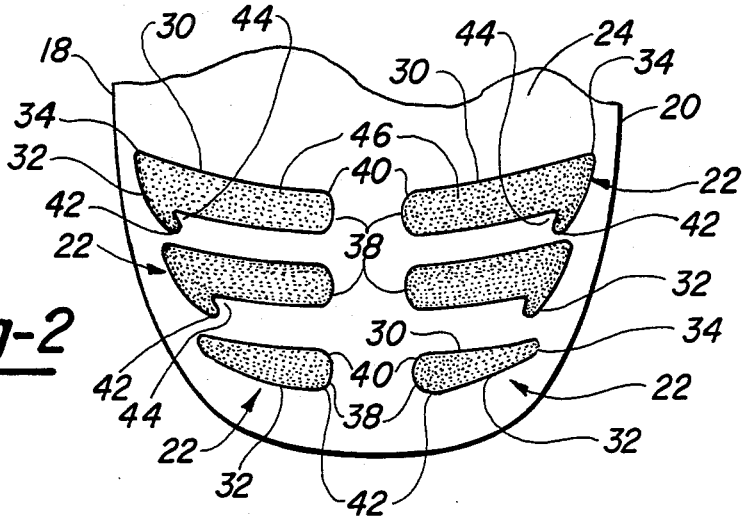
FIG. 2 is a fragmentary bottom plan view illustrating a preferred embodiment of the present invention.

Still referring to FIGS. 1 and 2, a plurality of cleats 22 extend outwardly from the heel 24 which penetrate the ground in use to provide traction for the athlete. Any type of conventional cleats 26 can be used on the front portion of the sole 12 and these cleats 26 will not be further described. The heel cleats 22, furthermore, can be made of any rigid material, such as metal, plastic, hard rubber, or the like.

With reference still to FIGS. 1 and 2, each cleat 22 includes a forwardly facing surface 30 and an outwardly facing surface 32. The forwardly facing cleat surface 30 preferably extends substantially transversely across the sole 12 while the outwardly facing surface 32 is angled with respect to the sole axis. The forwardly and outwardly facing cleat surfaces 30 and 32, furthermore, taper towards each other and meet each other at a point 34 which is adjacent one of the sides 18 or 20 of the sole 12. Thus, as best shown in FIG. 2, the forwardly and rearwardly facing cleat surfaces 30 and 32 are generally V-shaped when viewed in plan.

With reference now particularly to FIG. 2, the forwardly facing surface 30 of each cleat 22 terminates adjacent the middle of the sole 12. An inwardly or laterally facing cleat surface 38 then extends between the inner ends 40 and 42 of the forwardly and outwardly facing cleat surfaces 30 and 32, respectively. This laterally facing surface 38, furthermore, preferably includes a U-shaped recess 44 which faces the other lateral side 18 or 20 of the sole 12 i.e. the lateral side 18 or 20 of the sole 12 opposite from the side 18 or 20 adjacent the junction 34 of the cleat surfaces 30 and 32. Thus, for the cleats 22 having their forwardly and outwardly facing surfaces 30 and 32 meeting at a point 34 adjacent the side 18 of the sole 12, the U-shaped recesses 44 face the other side 20 of the sole 12, and vice versa.

With reference again to FIGS. 1 and 2, each cleat 22 preferably includes a lower flat surface 46 which is bounded by the surfaces 30, 32 and 38. This flat surface 46 is spaced outwardly from the sole 12 and preferably lies in a plane parallel to the sole 12.

Figure 3:
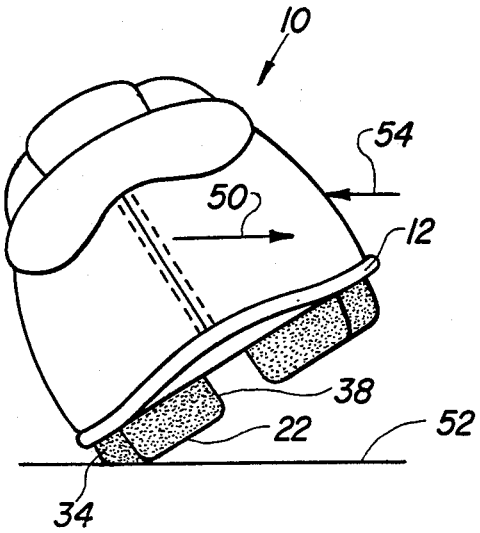
FIGS. 3 and 4 are rear diagrammatic views illustrating the preferred embodiment of the present invention in use.

With reference now to FIG. 3, a rear view of the athletic shoe 10 is thereshown. Assuming that the athlete exerts a rightward force on the shoe 10 as indicated by arrow 50 in order to produce leftward movement, the shoe 10 tilts slightly counterclockwise (shown with exaggeration in FIG. 3) with respect to the ground surface 52. In this event, the laterally facing surface 38 of the cleats 22 adjacent the left side of the shoe 10 (as viewed in FIG. 3) dig into or penetrate the ground 52 to provide traction in the desired fashion.

Conversely, assuming that a leftward force, such as indicated by arrow 54, is imposed on the shoe 10, as would occur in the event of a leftward blow to the athlete's legs, the shoe 10 also tilts in a counterclockwise direction as shown in exaggeration in FIG. 3. In this event, however, the junction or point 34 of the tapering forwardly and outwardly facing surfaces 30 and 32 maintains contact with the ground. This, in turn, minimizes the leftward traction between the ground 52 and the shoe 10 caused by the lateral blow 54 and allows the shoe 10 to slide leftwardly thereby minimizing stresses on the athlete's legs and feet.

Figure 4:
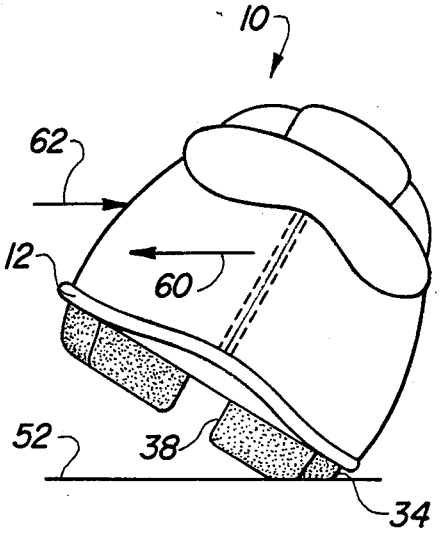

With reference now to FIG. 4, and assuming that the athlete produces a leftward force, as indicated by arrow 60, on the shoe 10 in order to move rightwardly, the shoe 10 tilts in a clockwise direction as shown in exaggeration in FIG. 4. In this event, the laterally facing surfaces 38 on the cleats 22 on the right hand side of the sole 12 penetrate the ground 52 and provide the desired traction.

Conversely, assuming a lateral rightward blow, as indicated by arrow 62, to the player's legs or feet, the junction or point 34 of the forwardly and outwardly facing surfaces 30 and 32 maintains contact with the ground 52. This, in turn, minimizes traction between the shoe 10 and the ground 52 and thus allows the shoe 10 to slide rightwardly. In doing so, the stress on the athlete's legs and feet is greatly reduced.

The forwardly facing and outwardly facing cleat surfaces 30 and 32 provide traction in the forward and rearward direction in the normal fashion.

Although in the preferred embodiment of the invention, there are two rows of cleats on the heel wherein each row includes three separate cleats, fewer or more cleats can be employed without deviation from the spirit or scope of the invention.

Having described my invention, however, many modifications thereto will become apparent to those skilled in the art to which it pertains without deviation from the spirit of the invention as defined by the scope of the appended claims.

I claim:

1. An athletic shoe comprising:

an elongated sole having a front, a back, an inner side and an outer side, said sides being spaced apart and extending between the sole front and sole back, at least one cleat, means for securing said at least one cleat to said sole adjacent the back of said sole, said cleat comprising a forwardly facing surface and an outwardly facing surface, one end of said forwardly facing surface meeting one end of said outwardly facing surface adjacent one side of said sole, said outwardly facing surface extending both rearwardly from said one end of said forwardly facing surface and also towards the center of the sole, said outwardly facing surface terminating in a second end which is rearward from a second end of said forwardly facing surface, said at least one cleat further comprising a laterally facing surface extending longitudinally between the other ends of said forwardly and outwardly facing cleat surfaces, at least a portion of said laterally facing surface facing the other lateral side of said sole.

2. The invention as defined in claim 1 and further comprising at least two of said cleats, wherein the laterally facing surface of one cleat faces one side of said sole and wherein the laterally facing surface of the other cleat faces the other side of said sole.

3. The invention as defined in claim 1 wherein said laterally facing surface includes a substantially U-shaped recess having an interior which faces said other lateral side of said sole.

4. The invention as defined in claim 3 wherein said cleat is laterally elongated.

5. The invention as defined in claim 1 wherein said cleat is constructed from hard rubber.

6. The invention as defined in claim 1 wherein said cleat has a lower surface which lies in a plane substantially parallel to a plane of said sole.

7. The invention as defined in claim 1 wherein said forwardly and outwardly facing surfaces are substantially V-shaped when viewed in plan.

8. The invention as defined in claim 7 wherein said forwardly facing surface extends substantially transversely across said sole.

9. The invention as defined in claim 8 wherein said second ends of said forwardly and outwardly facing surfaces terminate adjacent a transverse midpoint of said sole.

* * * * *